US006678494B2

(12) United States Patent
Kida et al.

(10) Patent No.: US 6,678,494 B2
(45) Date of Patent: Jan. 13, 2004

(54) IMAGE FORMING APPARATUS WITH TRANSFER MATERIAL GUIDE

(75) Inventors: Hiroshi Kida, Yamatokoriyama (JP); Hirokazu Yamauchi, Uji (JP); Yoshiaki Masuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/097,444

(22) Filed: Mar. 14, 2002

(65) Prior Publication Data

US 2002/0131796 A1 Sep. 19, 2002

(30) Foreign Application Priority Data

Mar. 16, 2001 (JP) ..... P2001-075127

(51) Int. Cl.[7] ..... G03G 15/16
(52) U.S. Cl. ..... 399/316
(58) Field of Search ..... 399/98, 297, 310, 399/313, 315, 316

(56) References Cited

U.S. PATENT DOCUMENTS 4,396,273 A * 8/1983 Matsuyama et al. ..... 399/316
4,544,262 A * 10/1985 Kanemitsu et al. ..... 399/316
4,922,303 A * 5/1990 Takeda et al. ..... 399/316 X
5,130,752 A * 7/1992 Morishita et al. ..... 399/315
5,138,396 A * 8/1992 Satou et al. ..... 399/316
5,225,879 A * 7/1993 Hayashida ..... 399/315
5,557,389 A * 9/1996 Sato et al. ..... 399/315
5,713,063 A * 1/1998 Oono ..... 399/316 X

FOREIGN PATENT DOCUMENTS

JP 07-128991 5/1995

* cited by examiner

*Primary Examiner*—Sandra Brase
(74) *Attorney, Agent, or Firm*—Renner, Otto, Boisselle & Sklar

(57) ABSTRACT

An object of the invention is to convey a transfer material properly and securely in a simple structure even where space allowance is limited. An image forming apparatus has a photoconductive body and a transfer device composed of a transfer roller. After a developer image formed on the photoconductive body is electrostatically transferred onto a sheet by the transfer roller, a rear end of the sheet having passed through opposed regions of the transfer roller and the photoconductive body is, by a guiding roller arranged at a downstream side of the opposed portions along a sheet conveying path, guided in conveyance from a non-transferred surface of the transfer material so that it is kept out of contact with the transfer roller.

19 Claims, 4 Drawing Sheets

IMAGE FORMING APPARATUS WITH TRANSFER MATERIAL GUIDE

BACKGROUND OF THE INVENTION

1. Field of the Invention

The present invention relates to an image forming apparatus such as a copying machine, a printer, or a facsimile apparatus employing an electrophotographic system as an image forming method, and more particularly to an image forming apparatus furnished with a transfer device for transferring a developer image formed on an image carrier onto a transfer material.

2. Description of the Related Art

In an image forming apparatus employing an electrophotographic photoconductor (hereafter abbreviated as "photoconductor") as an image carrier, image formation is achieved as follows. Firstly, the surface of the photoconductor is uniformly charged by a charging device and is thereafter exposed to light by an optical recording device so as to form an electrostatic latent image. Subsequently, the resultant electrostatic latent image is developed in a development device using a developer, and a developer image carried on the photoconductor is transferred onto a conveyed recording material by a transfer device. Lastly, the transferred developer image is fixed onto the recording material by a fixing device. The recording material onto which the developer image is fixed is available to users, for example, as an item representing an image.

Recently, in an image transfer process for transferring a developer image onto a recording material, there has been widely used a transfer system for performing transfer by bringing a transfer body, such as a transfer roller, transfer brush, or transfer block, into proximity to or abutment with a surface of an image carrier. This is because, this transfer system generates less ozone than a conventional electrostatic transfer system which exploits a discharge triggered by a corona discharge wire, and is therefore one of environmentally-friendly transfer systems.

However, in the above-stated transfer system for performing transfer by bringing a transfer body, such as a transfer roller, transfer brush, or transfer block, into proximity to or abutment with a surface of an image carrier, allowance of space for conveyance of a transfer material is less than in the conventional electrostatic transfer system employing a corona discharge wire. Thus, high conveyance accuracy is required.

That is, if the conveyance accuracy is low, the following problems arise. The transfer material tends to be deviated from a conveying path and may possibly be brought into contact with members arranged nearby, resulting in a bending or paper jam. Moreover, if the transfer material makes contact with the nearby members, a developer image having been already transferred is disturbed, or residual toner remaining on the surface of the image carrier, as well as toner scattered around the image carrier, inconveniently adhere to the surface of the transfer body, which has an adverse effect on the transfer process. Further, for example, environmental factors such as humidity surrounding the apparatus and the firmness of the transfer material are expected to vary widely. This makes it difficult to convey the transfer material in a wider range.

Specifically, there exist the following problems. During image formation is being conducted on a plurality of transfer materials, between the instant when image formation on a preceding transfer material is completed and the instant when a front-end portion of a subsequent transfer material enters opposed portions of the image carrier and the transfer body, namely, in a state where the transfer material is not present between the image carrier and the transfer body, the transfer body is inconveniently brought into direct contact with the surface of the image carrier. Consequently, toner stuck to the image carrier adheres to the surface of the transfer body. As a rear-end portion of the subsequent transfer material comes out of the opposed portions of the image carrier and the transfer body, the rear-end portion of the transfer material rubs against the surface of the transfer body with toner, and the toner undesirably stuck to the transfer body adheres to the rear-end portion of the transfer material, which results in the rear-end portion being stained. As a result, if the transfer material kept in a stained state is subjected to fixing process, the toner stuck to the rear-end portion is inconveniently fixed to the transfer material, and thus it is inevitable that the rear-end portion of the transfer material is stained.

SUMMARY OF THE INVENTION

An object of the invention is to provide an image forming apparatus which is capable of, despite having a simple structure, conveying a transfer material properly and securely even in a case where allowance of space is limited, for example, where an image carrier and a transfer body are arranged in proximate or abutting relation.

Another object of the invention is to provide an image forming apparatus which is capable of conveying a transfer material at a spaced interval with a transfer body so that a rear-end portion of the transfer material is kept out of abutment or contact with a surface of the transfer body.

The invention provides an image forming apparatus comprising:

an image carrier for carrying a developer image;

transfer means having a transfer body for electrostatically transferring the developer image carried on the image carrier onto a transfer material; and transfer material guiding means disposed at a downstream side of opposed portions of the image carrier and the transfer body along a direction in which the transfer material is conveyed, for guiding the transfer material in conveyance by acting upon a reverse surface of the transfer material in such a manner that, when a rear-end portion of the transfer material passes through the opposed portions, the rear-end portion is kept away from the transfer body.

According to the invention, the transfer material guiding means, which is disposed at a downstream side of the opposed portions of the image carrier and the transfer body along a transfer material conveying direction, guides the transfer material in conveyance by acting upon the reverse surface of the transfer material in such a manner that, when the rear-end portion of the transfer material passes through the opposed portions, the rear-end portion is kept away from the transfer body. Thus, even in a case where sufficient space allowance cannot be ensured in the vicinity of the opposed portions of the image carrier and the transfer body, conveyance of a transfer material can be achieved properly and securely in a relatively simple structure. Particularly, since the rear-end portion of the transfer material having undergone a transfer process is unlikely brought into contact with the surface of the transfer body, the rear-end portion of the transfer material is free from toner stains.

In the invention, it is preferable that the transfer material guiding means includes a rotary body which is supported so as to be rotatable about an axis arranged parallel to a width direction of the transfer material that is perpendicular to the transfer material conveying direction.

According to the invention, as the transfer material is conveyed (transported) downstream along the transfer material conveying direction, the rotary body abutting on the reverse surface of the transfer material is rotated. This helps reduce friction with respect to the transfer material and thus allows the transfer material to be guidedly supported on a fixing side smoothly.

In the invention, it is preferable that the transfer material guiding means includes a disc-shaped first guiding member and a second guiding member having a star-shaped axially perpendicular section, the first and second guiding members being integrally supported so as to be rotatable about the axis arranged parallel to a width direction of the transfer material that is perpendicular to the transfer material conveying direction.

According to the invention, the transfer material guiding means includes the disc-shaped first guiding member and the second guiding member having a star-shaped axially perpendicular section, and the first and second guiding members are integrally supported so as to be rotatable about the axis arranged parallel to the width direction of the transfer material that is perpendicular to the transfer material conveying direction. Thus, damage to a front-end portion of the transfer material can be reduced to minimum that is caused when the front end of the transfer material comes into collision with the transfer material guiding means. Moreover, when the transfer material guiding means guides the transfer material toward the fixing side by acting upon the reverse surface of the transfer material, an area of the contact surface between the reverse surface of the transfer material and the transfer material guiding means can be kept minimum. This allows the transfer material to be guidedly supported smoothly.

Further, in this construction, the extremity of the second guiding member is adequately engaged with the front-end portion of the transfer material. Therefore, the first and second guiding members, constituting the transfer material guiding means, can be integrally rotated with ease, thereby suppressing friction between the transfer material guiding means and the transfer material. In addition, the outer circumferential edge portion of the first guiding member serves to prevent the transfer material or the like from entering between the extremities of the second guiding member.

In the invention, it is preferable that between the transfer body and the transfer material guiding means is disposed charge removing means for subjecting the transfer material to charge removal treatment.

According to the invention, the transfer material, onto which a developer image is transferred by the transfer body, is guided by the transfer material guiding means while being subjected to charge removal treatment by the charge removing means. Since the transfer material is guided by the transfer material guiding means, a distance between the transfer material being guided by the transfer material guiding means and the charge removing means can be kept constant at all times. This makes it possible to remove charges remaining on the entire surface of the transfer material uniformly.

In the invention, it is preferable that a plurality of the transfer material guiding means are arranged in accordance with a width of the transfer material, in a direction perpendicular to the transfer material conveying direction, in such a way as to be parallel to the width direction of the transfer material.

According to the invention, the plurality of the transfer material guiding means are arranged, in accordance with the width of the transfer material, in such a way as to be parallel to the width direction of the transfer material. This allows the entire transfer material being conveyed along the conveying path to be guidedly supported securely in its width direction.

In the invention, it is preferable that a plurality of the transfer material guiding means are respectively arranged so as to correspond to the periphery of both widthwise end portions of the transfer material and the periphery of the widthwise central portion thereof, so that the transfer material is guidedly supported at its reverse surface in such a way that the transfer material varies in its thickness-direction position from part to part.

According to the invention, a plurality of the transfer material guiding means respectively support, in the peripheries of the widthwise end portions and widthwise central portion of the transfer material, the transfer material at its reverse surface, and simultaneously guide it in such a way that the transfer material varies in its thickness-direction position from part to part. Consequently, in consideration of the distortion or warpage of the transfer material passing through the region between the image carrier and the transfer body, an adequate firmness can be secured in the transfer material, so that the sheet as a whole can be guidedly supported easily.

In the invention, it is preferable that the transfer material guiding means is made of an electrically conductive material.

In the invention, it is preferable that the transfer material guiding means includes a guiding member coated with an electrically conductive material.

According to the invention, the transfer material guiding means is made of an electrically conductive material, or includes a guiding member coated with an electrically conductive material. Therefore, it never occurs that the transfer material guiding means is inadvertently electrified due to friction between it and the reverse surface of the transfer material, and thus the transfer material can be guidedly supported with stability. Moreover, the developer image being electrostatically supported on the transfer material is protected from adverse effects caused by charges.

The invention further provides an image forming apparatus comprising:

an image carrier for carrying a developer image;

transfer means having a transfer body for electrostatically transferring the developer image carried on the image carrier onto a transfer material; and transfer material guiding means disposed at a downstream side of opposed portions of the image carrier and the transfer body along a direction in which the transfer material is conveyed, the transfer material guiding means being rotated with conveyance of the transfer material by abutting on a surface of the transfer material opposite from a surface onto which the developer image is transferred.

According to the invention, the transfer material guiding means is disposed at a downstream side of the opposed portions of the image carrier and the transfer body along a transfer material conveying direction, and is rotated with conveyance of the transfer material by abutting on the surface of the transfer material opposite from the surface onto which the developer image is transferred. Thus, it is possible to reduce friction between the transfer material having passed through the opposed portions and the transfer material guiding means, thereby guidedly supporting the transfer material smoothly.

In the invention, it is preferable that the charge removing means includes a protective member which is made detachable, and that the transfer material guiding means is disposed on the protective member.

According to the invention, the transfer material guiding means is disposed on the detachable protective member. Accordingly, the transfer material guiding means can be detached from the charge removing means concurrently with detachment of the protective member from the charge removing means. This eliminates the need to detach the protective member and the transfer material guiding means separately for cleaning or replacement.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
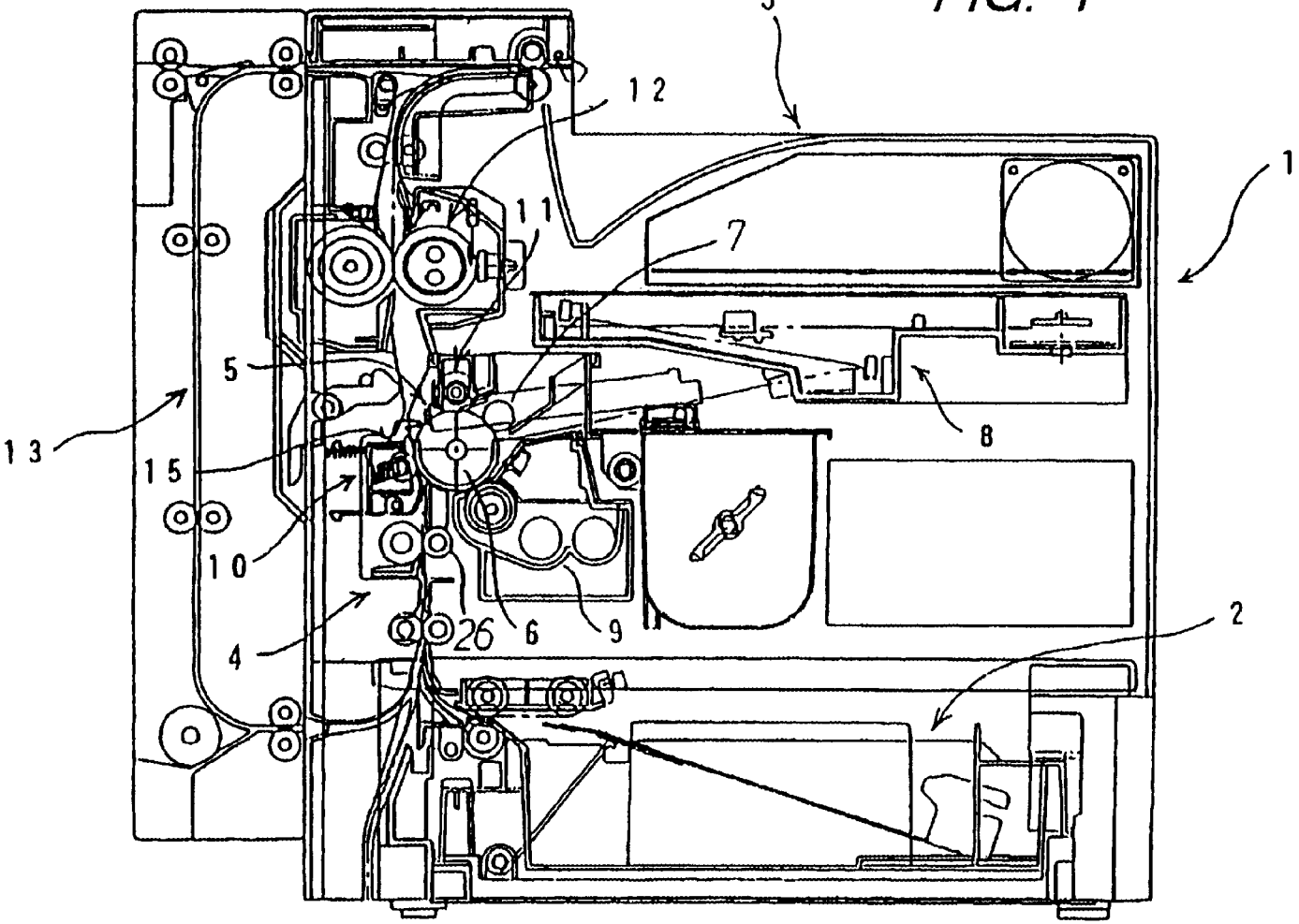
FIG. 1 is a sectional view illustrating an image forming apparatus in its entirety according to one embodiment of the invention.

Now referring to the drawings, preferred embodiments of the invention are described below.

FIG. 1 is a general sectional view of assistance in explaining an entire structure of an image forming apparatus (hereafter simply referred to as "apparatus") 1. The apparatus 1 has a paper feeding portion 2 disposed in its lower part (see the lower part of FIG. 1). In the apparatus 1, printing operation, i.e. image formation is conducted on a paper sheet, a typical transfer material, fed from the paper feeding portion 2. The sheet having undergone printing is fed into a paper ejecting portion 3, disposed in an upper part of the apparatus 1 (see the upper part of FIG. 1), with its one surface with an image on it facing downward. In conformity to this structure, a paper conveying path 4, serving as the connection between the paper feeding portion 2 and the paper ejecting portion 3, is formed so as to extend from the lower part to the upper part of the apparatus 1 in a substantially vertical direction. Partway along the length of the paper conveying path 4 is arranged an image forming portion 5.

Figure 2:
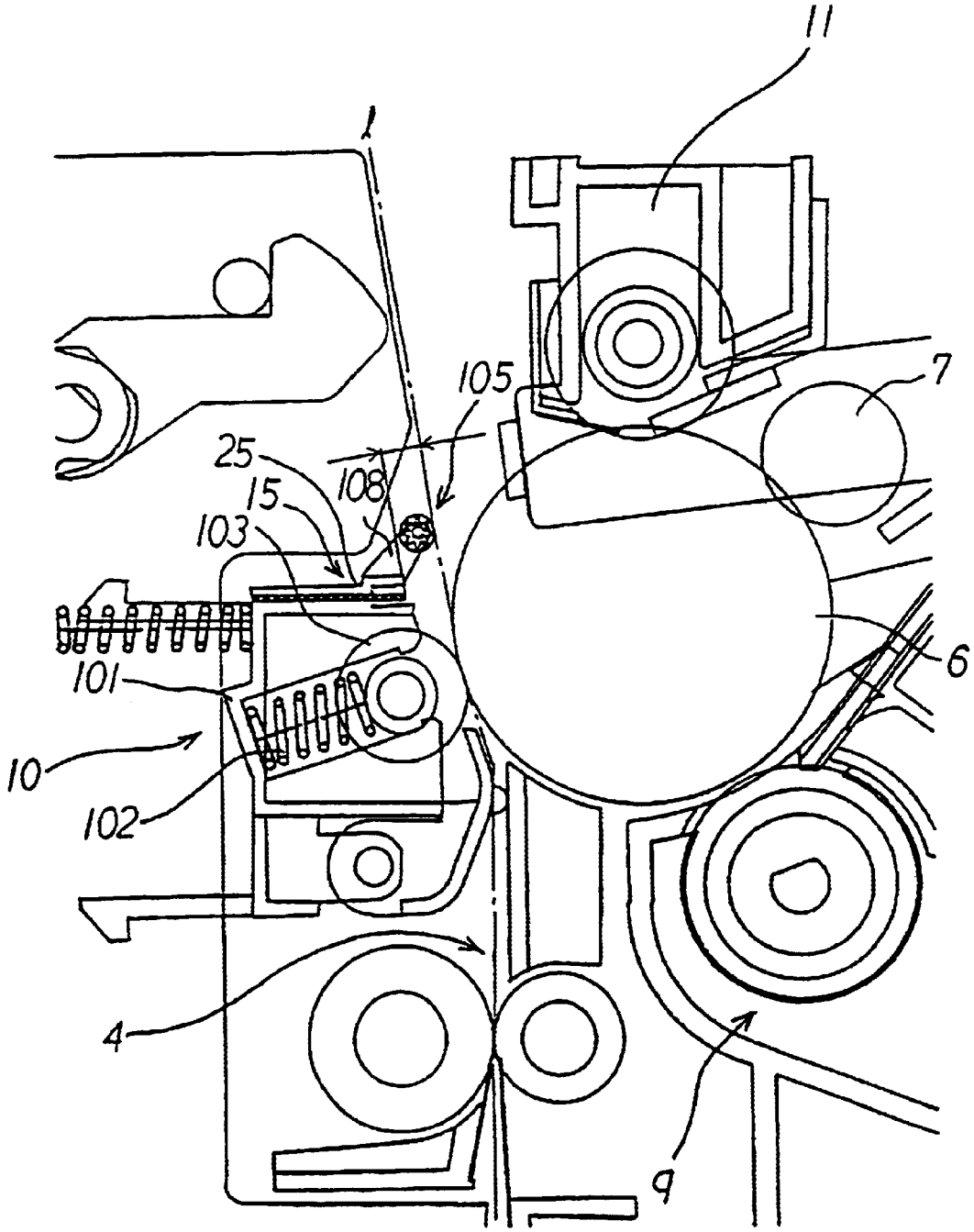
FIG. 2 is an enlarged sectional view illustrating a principal portion of a periphery of a transfer device according to the embodiment of the invention.

In the image forming portion 5, as seen from FIG. 2 showing its enlarged principal portion (described later), around a photoconductive drum 6, a typical image carrier, are disposed a charging device 7, an exposure device 8 such as a laser scanning unit, a development device 9, a transfer device 10 serving as transfer means, a cleaning device 11, and the like. At the time when a sheet passes through a region between the photoconductive body 6 and the transfer device 10, in particular a transfer body 103, namely, passes through opposed portions of the photoconductive drum 6 and the transfer body 103, a toner image, i.e. a developer image, formed on the photoconductive body 6 is electrostatically transferred onto the sheet. The sheet onto which the toner image is transferred then passes through a fixing portion 12 which is arranged at a downstream side of the paper conveying path 4 along a paper conveying direction in the transfer device 10, and thereby the toner image is fixed to the sheet as a perpetual visualized image. Note that the photoconductive body 6 does not necessarily have to be shaped like a cylindrical drum, as in this embodiment, but may be formed as an endless belt.

As shown in FIG. 1, a paper reversing path 13 of external type for use in duplex printing is arranged with its length aligned with a substantially vertical direction so as to be substantially parallel to the paper conveying path 4. In the paper reversing path 13, after an image is recorded on a first surface of the transfer material, the transfer material is turned upside down and is then fed to the image forming portion 5 once again, so that an image is formed on a second surface, i.e. the back of the first surface. Further, the above-described paper feeding portion 2 may be optionally furnished with a multi-stage paper feeding cassette which is disposed in the lower part of the apparatus 1. In this case, a variety of transfer materials of varying sizes, materials, or other factors can be supplied successively to the image forming portion 5. Note that the paper reversing path 13 does not necessarily have to be provided, and also the paper feeding portion 2 is not limited to the multi-stage type.

FIG. 2 is a sectional view of assistance in explaining the structure of the periphery of the transfer device 10, illustrating the enlarged principal portion thereof. In FIG. 2, the transfer device 10 is provided with a transfer body (hereafter sometimes referred to as "transfer roller") 103 composed of a rotary body that is arranged in abutment with or proximity to the surface of the photoconductive body 6. The surface of the photoconductive body 6 and the surface of the transfer roller 103 are arranged at a predetermined positional relation so as for the toner image formed on the photoconductive body 6 to be transferred onto the transfer material.

For example, the transfer roller 103 is constituted by winding an elastic material exhibiting electrical conductivity, such as an EPDM or urethane, around a core bar made of a metal material, and is designed to have an outer diameter of 14 to 20 mmϕ and hardness of 30 to 50 degrees (Asker C). Note that, while, in the following description, a case is shown in which the transfer body is realized by using a transfer roller, a transfer block or a transfer brush may be employed instead that is disposed in proximity to or abutment with the surface of the photoconductive body 6, as will be described later.

Moreover, in the paper conveying path 4, a charge removing device 15 is disposed at a downstream side of the transfer roller 103 along the paper conveying direction. The charge removing device 15 serves as charge removing means for subjecting the sheet, onto which the toner image is transferred, to charge removal treatment while the sheet is being peeled away from the photoconductive body 6. At a downstream side of the charge removing device 15 along the paper conveying direction is disposed a guiding roller 105 which serves as guiding means for supporting the sheet having undergone transfer process between the photoconductive body 6 and the transfer roller 103 by acting upon the reverse surface of the sheet, and guiding it downstream along the conveying path in the paper conveying direction. Note that, in this specification, for simplicity's sake, in the transfer material, its image-carrier-side surface onto which the electrostatic latent image carried on the image carrier is transferred will be referred to as a "surface" and its transfer-body-side surface at the back of said surface will be referred to as a "reverse surface".

In the first place, as shown in FIG. 2, a casing 101 of the transfer device 10, which is arranged with its length aligned with a direction perpendicular to the paper conveying direction (a direction perpendicular to the paper face on FIG. 2), is provided with the transfer roller 103 and a spring 102 formed as a helical compression spring. As described hereinabove, the transfer roller 103 is so disposed that an axial direction of its rotary shaft becomes parallel to an axial direction of the photoconductive body 6, so that the transfer roller 103 is disposed in abutment with or proximity to the photoconductive body 6. Moreover, the spring 102 has its one end abutted on a side wall portion of the casing 101 opposing the axial direction of the transfer roller 103, and has its other end abutted on the shaft portion of the transfer roller 103. At this time, the spring 102 is compressed to a predetermined degree prior to being attached to the casing 101. Thus, the transfer roller 103 is urged toward the photoconductive body 6 by a resilient force exerted by the spring 102 and held in position.

Further, at a downstream side of the casing 101 along the paper conveying direction is disposed the charge removing device 15 for removing unnecessary charges electrifying the sheet. At the further downstream side thereof is disposed the guiding roller 105 serving as transfer material guiding means.

In the apparatus of this embodiment, accordingly, a sheet is conveyed along the paper conveying path 4 from the lower part to the upper part of the apparatus. The sheet passes through the opposed portions of the photoconductive drum 6 and the transfer roller 103, namely, the transfer region. After the toner image formed on the photoconductive drum 6 is transferred onto the sheet, the sheet is conveyed along a straight line 1 while being guided at its reverse surface by the outer circumference edge of the guiding roller 105 disposed at a downstream side in the paper conveying direction.

Figures 3A, 3B, 3C:
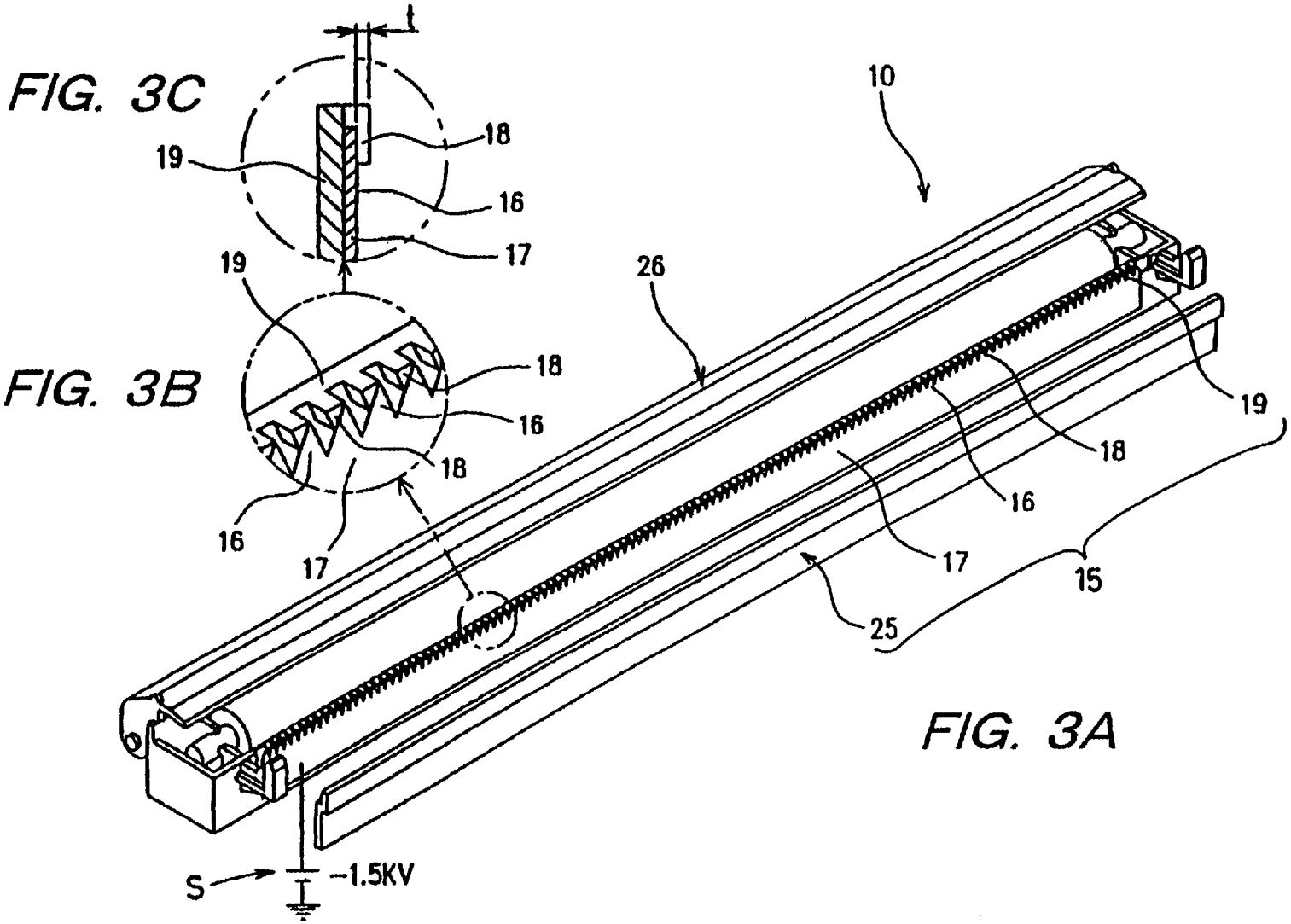
FIGS. 3A to 3C are exploded perspective views illustrating the transfer device according to the embodiment of the invention.

FIGS. 3A to 3C are exploded perspective views illustrating the transfer device 10. As shown in FIGS. 3A to 3C, for example, the charge removing device 15 is composed of a plurality of point discharge electrodes 16, a charge removing member 17, an insulating member 19, and a protective cover 25 formed as a protective member for protecting the charge removing member 17. The point discharge electrodes 16, which are disposed at one side edge of the charge removing device 15 substantially opposing the photoconductive drum 6, are arranged along the width direction of the sheet so as to face to the reverse surface of the sheet. The charge removing member 17 is formed of a stainless-made electrode plate in the form of a strip plate (thickness: 0.1 to 0.2 mm) to which a voltage of −1.5 KV is applied by a high-voltage power source S. The insulating member 19 supports the point discharge electrodes 16 at their back sides and has a plurality of projections 18 of which each is formed between the adjacent point discharge electrodes 16 so as to protrude beyond the thickness of the electrode by an amount of "t" indicated in the figure. The protective cover 25 is made detachable and disposed so as to cover the entire longitudinal front surface of the charge removing member 17 (the top surface of the charge removing device 15, in FIG. 2).

The protective cover 25 has a stepped configuration in which its certain part facing to the projections 18 of the insulating member 19 is bent so as to steppedly extend slightly forward. Although not illustrated in the figure, the protective cover 25 is detachably attached to the front surface of the charge removing member 17 by fitting means based upon a variety of engagement/retaining techniques, for example, projection-recess engagement or screw engagement. Consequently, the protective cover 25 can be removed with ease when the charge removing member 17 requires cleaning or replacement.

Moreover, although not illustrated in FIG. 3A, in the part of the protective cover 25 that is bent so as to steppedly extend slightly forward, namely, at a downstream side along the conveying path in the paper conveying direction, is provided a guiding roller (hereafter sometimes referred to as "guiding member") 105 for guidedly supporting a sheet being conveyed by acting upon the reverse surface thereof. In this embodiment, accordingly, the guiding roller 105 is provided in the protective cover 25 of the charge removing device 15. Thus, the guiding roller 10 can be detached from the charge removing device 15 concurrently with detachment of the protective cover 25 from the charge removing device 15. This eliminates the need to detach the protective cover 25 and the guiding roller 105 separately for cleaning or replacement.

Figures 4A, 4B:
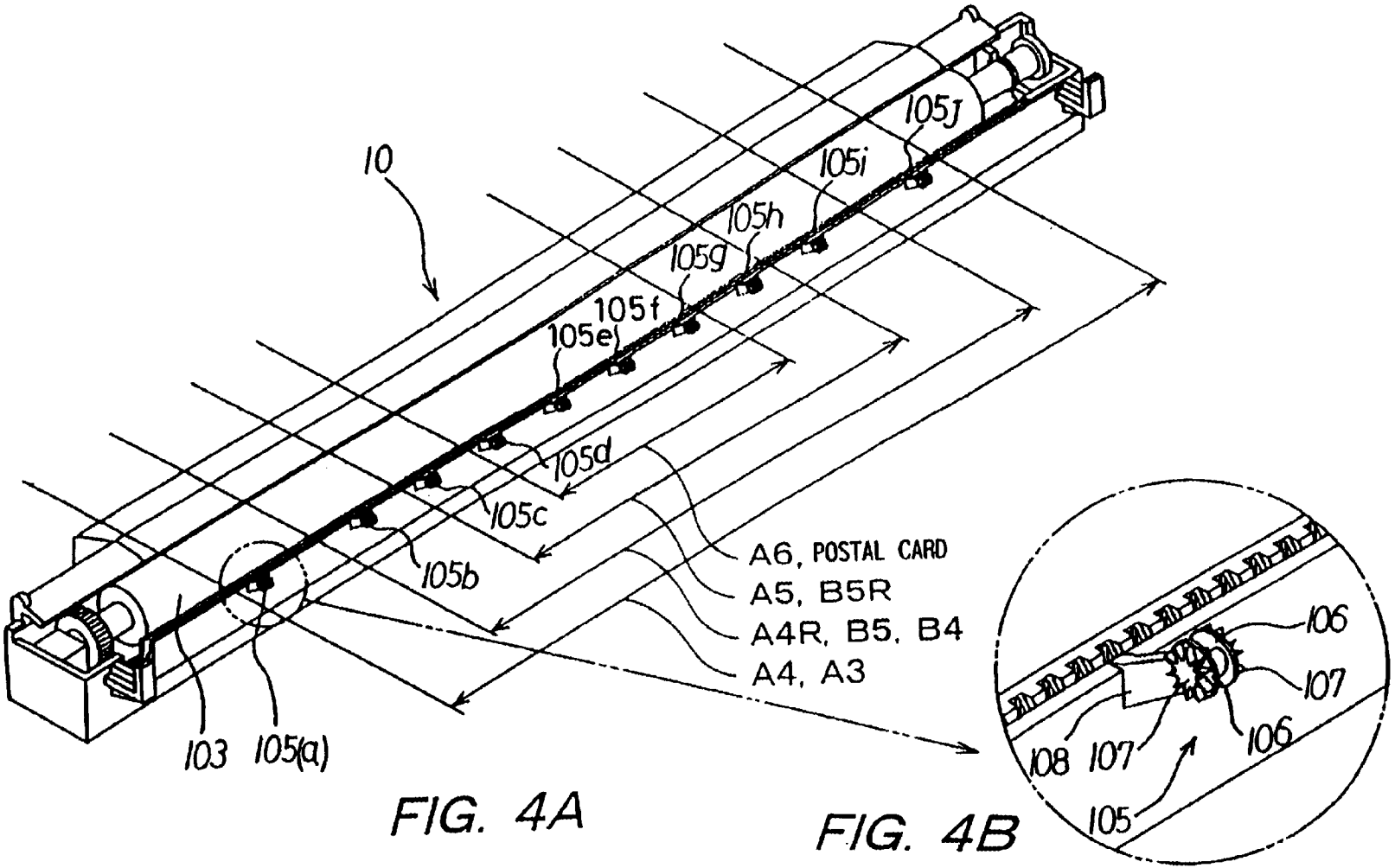
FIGS. 4A and 4B are perspective views illustrating the transfer device according to the embodiment of the invention.

FIGS. 4A and 4B are perspective views illustrating the transfer device 10 provided with the guiding roller 105. The guiding roller 105 serves to guide a conveyed sheet, having passed through the region between the photoconductive body 6 and the transfer roller 103, toward the downstream side along the conveying path in the paper conveying direction by acting upon the reverse surface of the sheet from the front end through rear end thereof. Here, the action of the guiding roller 105 means, during the sheet having passed through the opposed portions of the photoconductive body 6 and the transfer roller 103 further travels along the conveying path, facilitating the conveyance of the sheet to achieve proper guiding while making contact with the reverse surface of the sheet on an as-needed basis. In this construction, even in a case where a sufficient space allowance cannot be ensured in the vicinity of the opposed portions of the image carrier and the transfer body, conveyance of the transfer material can be achieved properly and securely in a relatively simple structure. Particularly, since the rear-end portion of the transfer material having undergone transfer process is unlikely brought into contact with the surface of the transfer body, the rear-end portion of the transfer material is free from toner stains.

Further, the guiding roller 105 is composed of a rotary body that is supported so as to be rotatable about the axis arranged parallel to a width direction of a sheet which is perpendicular to the paper conveying direction. Thus, as the transfer material is conveyed (transported) downstream along the transfer material conveying direction, the rotary body abutting on the reverse surface of the transfer material is rotated. This helps reduce friction with respect to the transfer material and thus allows the transfer material to be guidedly supported on the fixing side smoothly.

Still further, as seen from FIG. 4B showing an enlargement view, the guiding roller 105 includes a disc-shaped first guiding member 106 and a second guiding member 107 having a star-shaped axially perpendicular section (star-like configuration). The first and second guiding members 106 and 107 are each made rotatable. In the following description, a case will be shown in which the second guiding member 107 has a star-like configuration (has a star-shaped sectional profile when viewed in a direction perpendicular to the rotary axis).

Note that the star-shaped second guiding member is employed as a preferred example, because the front-end or other portion of the sheet can engage easily in the concave portions between the extremities thereof. However, the second guiding member may have any other configuration so long as it has a plurality of extremities formed circumferentially thereof. For example, a polygonal configuration. Also in this case, as will be described later, the extremities of the second guiding member serve to facilitate the rotation of the transfer material guiding means 105. Moreover, it is also possible to construct the second guiding member in such a manner that it has a cross or asterisk sectional profile when viewed in a direction perpendicular to the rotary axis, by combining together flat plate members intersecting one another at the center of the rotary axis. In addition, the configuration of the first guiding member is not limited to the disc shape, but may be of another shape such as cylindrical shape.

In the embodiment in question, the outer circumferential edge of the first guiding member 106 and the outer circumferential edge of the second guiding member 107, namely, an outer circumferential edge of a circle circumscribed around the second guiding member 107, are arranged so as to substantially coincide with each other, that is, arranged so as to be substantially identical in diameter or contour with each other in the sectional direction thereof. In this way, the guiding roller 105, when viewed in the rotary axis direction, has a dimensional relation such that the outer circumferential edge of the first guiding member 106 is so arranged as to substantially circumscribe the extremities of the second guiding member 107. In other words, the outer circumference of the first guiding member 106 and the circle circumscribed around the second guiding member 107 are substantially identical in diameter with each other. Note that, in a case where the guiding roller 105 is so designed that the second guiding member 107 is disposed between two first guiding members 106, if the extremities of the second guiding member 107 are extended radially inwardly of the outer circumferential edge of the first guiding member 106, the front-end portion of the sheet is inhibited from engaging in between the extremities of the second guiding member 107 smoothly. Therefore, it is preferable that the extremities of the second guiding member 107 are so formed as to protrude beyond the outer circumferential edge of the first guiding member 106.

Note that the first and second guiding members 106 and 107 may be fabricated separately first and thereafter engaged or fitted with each other, or formed integrally with each other in the first place, to form the guiding roller 105 acting as the transfer guiding means.

As a material for use as the first and second guiding members 106 and 107, a tough material having a mechanical property equivalent to metal, such as POM (Polyoxymethylen), is desirable. POM may preferably have its surface coated with a conductive material such as carbon, or may contain a conductive material such as carbon. Moreover, the guiding member may have its one part made of a conductive material, for example, a metal material.

Although, in this description, the preferred embodiment deals with the case where the transfer material guiding means is realized as a rotary body, namely, a guiding roller, the transfer material guiding means may be formed instead as a rib-shaped guiding member in which at least a part which rubs against a sheet is subjected to a treatment such as coating of a conductive material (hereafter referred to as "conduction treatment"). The guiding member may also be composed of a conductive material. For example, assuming that the guiding member is formed as a rib and the rib is made of a material exhibiting an insulating property. In this case, by subjecting at least a part which rubs against a sheet to the conduction treatment, the sheet can be guided in conveyance effectively. Moreover, since the rib itself is subjected to the conduction treatment, unnecessary charging due to friction never occurs. Note that, it will be easily understood by those skilled in the art that, where the rib is made of a material exhibiting conductivity, it is unnecessary to carry out the conduction treatment on the rib, but substantially the same effects as achieved in the case where the conduction treatment is performed can be attained.

In particular, in a case where the transfer device employs a transfer body composed of a roller, a block, a brush, or the like instead of employing a transfer charger, it is inevitable that the space around the transfer region becomes narrower. In this case, occurrence of such problems as described previously cannot be avoided unless the conveyance of the sheet is guided properly. In light of this, by imparting conductivity to the guiding member, it is possible to prevent accumulation of charges on the guiding member due to friction between the guiding member and the sheet being conveyed. This frees the yet-to-be-fixed toner image transferred onto the sheet from adverse effects such as a disturbed image.

Next, the guiding action of the guiding roller 105 will be described. At the time when the sheet passes through the opposed portions of the photoconductive drum 6 and the transfer body 103, namely, the transfer region, and the front-end portion of the sheet reaches the guiding roller 105, the front-end-portion of the sheet is brought into contact, i.e. abutment with the extremities of the second guiding member 107, and thereby the guiding roller 105 is rotated. The first guiding member 106 is rotated in synchronism with the rotation of the guiding roller 105. Accordingly, as the front-end portion of the conveyed sheet abuts on the guiding roller 105, the guiding roller 105 is rotated. Further, the reverse surface of the sheet is acted upon by the extremities of the second guiding member 107, and thereby the guiding roller 105 continues to guide the sheet while rotating until the rear-end portion of the sheet comes out of the transfer device 10.

Here, a description will be given as to the reason why the guiding roller 105 is constituted by using both of the first and second guiding members 106 and 107. Assuming that the guiding roller 105 is composed solely of the first guiding member 106 without using the second guiding member 107. In this case, the front-end portion of the sheet abuts on the outer circumferential edge portion of the first guiding member 106. At this time, depending upon the material of the sheet, the conveyance velocity, the material of the first guiding member 106, humidity, or other factors, in some cases the first guiding member 106 may be rotated, in other cases it may remain unrotated.

In the case where the first guiding member 106 remains unrotated, friction occurs between the sheet and the first guiding member 106. If the conduction treatment has not been carried out, the sheet is rubbed and electrified, which causes a disturbed toner image. Moreover, as the first guiding member 106 wears out, the positional relationship, such as the angle at which the guiding roller 105 guides the sheet, is varied, with the result that the guiding operation cannot be performed with stability, or that noise is caused by friction among the sheet, the first guiding member 106, and others. On the other hand, even in the case where the guiding roller 105 is rotated, in order for the guiding member 105 to be securely rotated irrespective of the type of sheet and humidity, there is a need to allow for margins in considering the material, configuration, surface condition, and arrangement of the guiding roller 105. This inconveniently lowers the design flexibility.

Next, assuming that the guiding roller 105 is composed solely of the second guiding member 107. In this case, there occurs less friction due to abutment of the front-end portion of the conveyed sheet on the extremities of the second guiding member 107, and therefore the guiding roller 105 can be rotated relatively easily. However, when the front-end portion of the sheet enters a gap between the adjacent extremities, various problems arises. For example, the front-end portion of the sheet is bent, paper jamming takes place, or the toner image formed on the sheet is disturbed.

By contrast, in the embodiment, the first and second guiding members 106 and 107 are designed to be rotated concurrently. Thus, in spite of the simple structure, remarkable advantages are attained: rotation can be easily achieved without causing friction; and the first guiding member 106 serves to prevent the sheet from entering between the extremities of the second guiding member 107. That is, by the rotation of the guiding roller 105, the sheet is prevented from sliding locally in a certain part of the guiding roller 105. Consequently, the sheet is free from damage due to the sliding movement. Moreover, even though the sheet having passed through the transfer region is slightly deviated from the conveying path, by the rotation of the transfer roller 105, the sheet is guided smoothly. This eliminates occurrence of paper jamming due to undesired firmness of the sheet. Further, by the rotation of the transfer roller 105, friction between the transfer roller 105 and the sheet can be reduced to minimum. This makes it possible to avoid unnecessary electrification due to friction and thus avoid adverse effects on the transfer operation or the like. Still further, it never occurs that friction is produced locally in a certain position of the guiding roller 105. Thus, various problems can be solved, for example, unstable guiding operation due to abrasion of the guiding roller 105, needless replacement of the guiding roller 105, or contamination of the apparatus and hindrance to the transfer process due to fine particles generated as a result of abrasion, scattered paper fragments, and the like.

Note that, although, in this embodiment, as shown in FIG. 4B, the guiding roller 105 is provided with two pairs of the first and second guiding members 106 and 107, the invention is not limited thereto. For example, the guiding roller 105 may also be provided with two pieces of the first guiding members 106 and a single piece of the second guiding member 107. In this case, substantially the same effects can be attained. However, since the sheet is frequently brought into a deformed state, the second guiding member 107 should preferably be disposed in the side portion of the guiding roller 105, as viewed in a direction of the axis center thereof, instead of being arranged so as to be sandwiched between the two first guiding members 106. This is because, in the former case, the extremities of the second guiding members can make contact with the transfer material more easily, thereby facilitating the rotation of the guiding roller 105.

The protective cover 25 is provided with a supporting member 108 for rotatably supporting the guiding roller 105. As shown in FIG. 2, the supporting member 108 is formed so as to extend in a direction substantially parallel to the tangent of the outer circumferential edge of the photoconductive body to allow the sheet to be conveyed in a direction along the straight line 1. Note that a direction in which the supporting member 108 extends is not limited to the direction substantially parallel to the tangent of the outer circumferential edge of the photoconductive body, but may preferably be so set that the tangents of the photoconductive body 6, the transfer roller 103, and the guiding roller 105 are all located on substantially the same straight line. In this way, the reverse surface of the conveyed sheet having passed through the region between the photoconductive body 6 and the transfer roller 103 is brought into contact with the guiding roller smoothly, thereby guiding the sheet smoothly.

Moreover, the guiding roller 105 should preferably be arranged in a positional relation such that, at the time of coming out of the transfer region, the rear-end portion of the sheet is kept out of contact with the transfer roller 103. That is, the position of the guiding roller 105 is so set that, at the time when the rear-end portion of the sheet comes out of the transfer region, the length between the paper's position making contact with the guiding roller 105 and its rear-end position is made smaller than the distance between the guiding roller 105's position making contact with the sheet and the transfer roller 103. In this way, the sheet as a whole can be guided securely without its rear-end portion, having passed through the region between the photoconductive body 6 and the transfer roller 103, being abutted on the surface of the transfer roller 103 to scrape off the toner stuck to the surface of the transfer roller 103.

Further, between the transfer roller 103 and the guiding roller 105 is disposed a charge removing device 17 for removing charges remaining on the sheet after the transfer process from the reverse surface of the sheet. As seen from FIG. 2, the distance between the sheet being guided by the guiding roller 105 and the front end of the charge removing device 17 is kept constant at all times. Thus, the charges remaining over the entire surface of the sheet can be uniformly removed.

Still further, as seen from FIG. 4A, in accordance with a width (size) of a sheet being conveyed along the conveying path, namely, the sheet width as viewed in a direction perpendicular to the sheet conveying direction, a plurality of the guiding rollers 105 are arranged parallel to the width of the sheet. This arrangement allows a sheet to be guidedly supported properly irrespective of paper width. For example, in this embodiment, the guiding rollers 105 are respectively arranged near the widthwise central part and near the two widthwise end portions of the paper sheet according to paper size. That is, an A6-size sheet or a sheet of postal card size is guidedly supported by the guiding rollers 105*d* to 105*g*; an A5-size or B5R-size sheet is guidedly supported by the guiding rollers 105*c* to 105*h*; an A4R-size, B5-size, or B4-size sheet is guidedly supported by the guiding rollers 105*b* to 105*i*; and an A4-size or A3-size sheet is guidedly supported by the guiding rollers 105*a* to 105*j*. In this way, the sheet is guidedly supported by a plurality of guiding rollers 105*d* to 105*g*; 105*c* to 105*h*; 105*b* to 105*i*; and 105*a* to 105*j* according to paper size.

Note that, in the embodiment shown in FIG. 4A, conveyance of a sheet is conducted with reference to the central part of the construction. Therefore, of all the guiding members 105*a* to 105*j*, the guiding members 105*d* to 105*g* correspond to any of the above-described paper sizes, and the guiding rollers are symmetrically arranged with respect to the central reference position along a direction toward the lengthwise end portion of the charge removing device 17. On the other hand, where conveyance of a sheet is conducted with reference to one side of the construction, the guiding rollers 105*a* to 105*j* are arranged one by one from the one-sided reference position according to paper size. For example, they are respectively arranged in the one-sided reference portion and in a position near the end portion of the sheet according to paper size.

Moreover, while, in FIG. 4, an embodiment is shown in which the guiding rollers 105 are arranged in a row laterally along the width direction of the sheet, the guiding rollers 105 may be arranged otherwise, so that the widthwise central portion and the two widthwise end portions of the sheet are located in different positions. That is, in this case, by arranging a plurality of guiding rollers in the vicinity of the widthwise end portions and the widthwise central portion of the paper sheet, the sheet is guidedly supported at its reverse surface in such a way that the sheet varies in its thickness-direction position from portion to portion.

For example, the sheet may be so arranged that the widthwise central portion becomes lower in level than the widthwise end portions, or, by contrast, so arranged that the widthwise central portion becomes higher in level than the widthwise end portions. Moreover, the diameter of the rotary body acting upon the periphery of the sheet's widthwise central portion may be made larger or smaller than the diameter of the rotary body acting upon the periphery of the sheet's widthwise end portions. This makes it possible to allow the sheet as a whole to be guidedly supported with ease by exploiting the distortion, i.e. warpage of the sheet having passed through the region between the photoconductive body 6 and the transfer roller 103.

Note that, in order for the sheet to be arranged so that the widthwise central portion becomes lower in level than the widthwise end portions, for example, the positions of the guiding rollers 105 corresponding to the widthwise central portion and those corresponding to the other portions are changed, or adequate firmness is imparted to the sheet by bending, which is facilitated by intentionally providing guiding-roller 105-free portions exploiting the sheet's own weight. In a similar manner, the sheet can be arranged so that the widthwise central portion becomes higher in level than the widthwise end portions.

Further, in the above-described embodiment, the transfer body incorporated in the transfer device 10 is explained as the transfer roller 103. However, even if the transfer body is realized as a transfer block or brush that is disposed in proximity to or abutment with the surface of the photoconductive body 6, substantially the same effects can be attained. In particular, the embodiment in question can be considered preferable because of its highly appreciable advantages. That is, the transfer material guiding means is disposed at a downstream side of the opposed portions of the image carrier and the transfer body along the conveying path in the paper conveying direction, so that the rear-end portion of the transfer material is located away from the surface of the transfer body. Thus, the toner of the yet-to-be-fixed toner image transferred onto the transfer material is prevented from adhering to the transfer body, thereby protecting the rear-end portion of the transfer material from toner stains during the transfer process.

Still further, the positions of the guiding rollers 105 are not limited to the region between the downstream side of the opposed portions along the conveying path in the paper conveying direction and the fixing portion. For example, the guiding rollers 105 may be arranged at a downstream side of the fixing portion 12 along the conveyance path in the paper conveying direction, at an upstream side of the opposed portions, or at an upstream or downstream side of a resist roller 26. These arrangements are also applicable to, for example, a case where, during paper guiding, the paper's end portion such as the front-end or rear-end portion is deviated from the paper conveying path and possibly impinges upon the nearby members. In this case, although the advantage of preventing adhesion of toner to the rear-end portion of the sheet, as achieved in this embodiment, may not be presented, the transfer material can be conveyed properly and securely in a simple structure in spite of the small allowance of space. Moreover, in this case, the transfer material guiding means may be arranged not only in the conveying path within the image forming apparatus, but also in an optional double-sided unit or a conveying path of an after-treatment unit such as a sorter or stapler.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an image carrier for carrying a developer image;

transfer means having a transfer body for electrostatically transferring the developer image carried on the image carrier onto a transfer material; and transfer material guiding means disposed at a downstream side of opposed portions of the image carrier and the transfer body along a direction in which the transfer material is conveyed, for guiding the transfer material in conveyance by acting upon a reverse surface of the transfer material in such a manner that, when a rear-end portion of the transfer material passes through the opposed portions, the rear-end portion is kept away from the transfer body, wherein the transfer material guiding means includes a rotary body which is supported so as to be rotatable about an axis arranged parallel to a width direction of the transfer material that is perpendicular to the transfer material conveying direction.

2. The image forming apparatus of claim 1, wherein a plurality of the transfer material guiding means are arranged in accordance with a width of the transfer material, in a direction perpendicular to the transfer material conveying direction, in such a way as to be parallel to the width direction of the transfer material.

3. The image forming apparatus of claim 2, wherein a plurality of the transfer material guiding means are respectively arranged so as to correspond to the periphery of both widthwise end portions of the transfer material and the periphery of the widthwise central portion thereof, so that the transfer material is guidedly supported at a reverse surface thereof in such a way that the transfer material varies in its thickness-direction position from part to part.

4. An image forming apparatus comprising:

an image carrier for carrying a developer image:

transfer means having a transfer body for electrostatically transferring the developer image carried on the image carrier onto a transfer material; and transfer material guiding means disposed at a downstream side of opposed portions of the image carrier and the transfer body along a direction in which the transfer material is conveyed, for guiding the transfer material in conveyance by acting upon a reverse surface of the transfer material in such a manner that, when a rear-end portion of the transfer material passes through the opposed portions, the rear-end portion is kept away from the transfer body, wherein the transfer material guiding means includes a disc-shaped first guiding member and a second guiding member having a star-shaped axially perpendicular section, the first and second guiding members being integrally supported so as to be rotatable about the axis arranged parallel to a width direction of the transfer material that is perpendicular to the transfer material conveying direction.

5. The image forming apparatus of claim 4, wherein a plurality of the transfer material guiding means are arranged in accordance with a width of the transfer material, in a direction perpendicular to the transfer material conveying direction, in such a way as to be parallel to the width direction of the transfer material.

6. The image forming apparatus of claim 5, wherein a plurality of the transfer material guiding means are respectively arranged so as to correspond to the periphery of both widthwise end portions of the transfer material and the periphery of the widthwise central portion thereof, so that the transfer material is guidedly supported at a reverse surface thereof in such a way that the transfer material varies in its thickness-direction position from part to part.

7. An image forming apparatus comprising:

an image carrier for carrying a developer image;

transfer means having a transfer body for electrostatically transferring the developer image carried on the image carrier onto a transfer material; and transfer material guiding means disposed at a downstream side of opposed portions of the image carrier and the transfer body along a direction in which the transfer material is conveyed, for guiding the transfer material in conveyance by acting upon a reverse surface of the transfer material in such a manner that, when a rear-end portion of the transfer material passes through the opposed portions, the rear-end portion is kept away from the transfer body, wherein between the transfer body and the transfer material guiding means is disposed charge removing means for subjecting the transfer material to charge removal treatment.

8. The image forming apparatus of claim 7, wherein a plurality of the transfer material guiding means are arranged in accordance with a width of the transfer material, in a direction perpendicular to the transfer material conveying direction, in such a way as to be parallel to the width direction of the transfer material.

9. The image forming apparatus of claim 8, wherein a plurality of the transfer material guiding means are respectively arranged so as to correspond to the periphery of both widthwise end portions of the transfer material and the periphery of the widthwise central portion thereof, so that the transfer material is guidedly supported at a reverse surface thereof in such a way that the transfer material varies in its thickness-direction position from part to part.

10. The image forming apparatus of claim 7, wherein the charge removing means includes a protective member which is made detachable, and wherein the transfer material guiding means is disposed on the protective member.

11. An image forming apparatus comprising:

an image carrier for carrying a developer image;

transfer means having a transfer body for electrostatically transferring the developer image carried on the image carrier onto a transfer material; and transfer material guiding means disposed at a downstream side of opposed portions of the image carrier and the transfer body along a direction in which the transfer material is conveyed, for guiding the transfer material in conveyance by acting upon a reverse surface of the transfer material in such a manner that, when a rear-end portion of the transfer material passes through the opposed portions, the rear-end portion is kept away from the transfer body, wherein the transfer material guiding means is made of an electrically conductive material.

12. The image forming apparatus of claim 11, wherein a plurality of the transfer material guiding means are arranged in accordance with a width of the transfer material, in a direction perpendicular to the transfer material conveying direction, in such a way as to be parallel to the width direction of The transfer material.

13. The image forming apparatus of claim 12, wherein a plurality of the transfer material guiding means are respectively arranged so as to correspond to the periphery of both widthwise end portions of the transfer material and the periphery of the widthwise central portion thereof, so that the transfer material is guidedly supported at a reverse surface thereof in such a way that the transfer material varies in its thickness-direction position from part to part.

14. An image forming apparatus comprising:

an image carrier for carrying a developer image; transfer means having a transfer body for electrostatically transferring the developer image carried on the image carrier onto a transfer material; and transfer material guiding means disposed at a downstream side of opposed portions of the image carrier and the transfer body along a direction in which the transfer material is conveyed, for guiding the transfer material in conveyance by acting upon a reverse surface of the transfer material in such a manner that, when a rear-end portion of the transfer material passes through the opposed portions, the rear-end portion is kept away from the transfer body, wherein the transfer material guiding means includes a guiding member coated with an electrically conductive material.

15. The image forming apparatus of claim 14, wherein a plurality of the transfer material guiding means are arranged in accordance with a width of the transfer material, in a direction perpendicular to the transfer material conveying direction, in such a way as to be parallel to the width direction of the transfer material.

16. The image forming apparatus of claim 15, wherein a plurality of the transfer material guiding means are respectively arranged so as to correspond to the periphery of both widthwise end portions of the transfer material and the periphery of the widthwise central portion thereof, so that the transfer material is guidedly supported at a reverse surface thereof in such a way that the transfer material varies in its thickness-direction position from part to part.

17. An image forming apparatus comprising:

an image carrier for carrying a developer image;

transfer means having a transfer body for electrostatically transferring the developer image carried on the image carrier onto a transfer material; and transfer material guiding means disposed at a downstream side of opposed portions of the image carrier and the transfer body along a direction in which the transfer material is conveyed, the transfer material guiding means being rotated with conveyance of the transfer material by abutting on a surface of the transfer material opposite from a surface onto which the developer image is transferred, wherein the transfer material guiding means comprises an electrically conductive material.

18. The image forming apparatus of claim 17, wherein a plurality of the transfer material guiding means are arranged in accordance with a width of the transfer material, in a direction perpendicular to the transfer material conveying direction, in such a way as to be parallel to the width direction of the transfer material.

19. The image forming apparatus of claim 17, wherein a plurality of the transfer material guiding means are respectively arranged so as to correspond to the periphery of both widthwise end portions of the transfer material and the periphery of the widthwise central portion thereof, so that the transfer material is guidedly supported at a reverse surface thereof in such a way that the transfer material varies in its thickness-direction position from part to part.

* * * * *